US012558584B2

(12) United States Patent
Kannel

(10) Patent No.: US 12,558,584 B2
(45) Date of Patent: Feb. 24, 2026

(54) RESISTANCE ADJUSTMENT DEVICE OF EXERCISE APPARATUS

(71) Applicant: Johnson Health Tech. Co., Ltd., Taichung City (TW)

(72) Inventor: Mark Kannel, Oconomowoc, WI (US)

(73) Assignee: Johnson Health Tech Co., Ltd., Taichung City (TW)

( * ) Notice: Subject to any disclaimer, the term of this patent is extended or adjusted under 35 U.S.C. 154(b) by 241 days.

(21) Appl. No.: 18/219,696

(22) Filed: Jul. 9, 2023

(65) Prior Publication Data

US 2025/0010119 A1 Jan. 9, 2025

(51) Int. Cl.
*A63B 21/00* (2006.01)
*A63B 22/06* (2006.01)

(52) U.S. Cl.
CPC .... *A63B 21/00192* (2013.01); *A63B 22/0605* (2013.01)

(58) Field of Classification Search
CPC ..... A63B 21/00069; A63B 21/00192; A63B 21/0051; A63B 21/225; A63B 21/005; A63B 21/0052; A63B 21/0056; A63B 21/0057; A63B 22/0605; A63B 22/22; A63B 22/222; A63B 22/225; A63B 22/227; A63B 22/06; A63B 22/0664; A63B 2022/0611; A63B 2022/0617; A63B 2022/0623; A63B 2022/0629; A63B 2022/0635; A63B 2022/0641; A63B 2022/0647; A63B 2022/0652; A63B 2022/0658; A63B 2022/067; A63B 2022/0676; A63B 2022/0682; A63B 2022/0688
See application file for complete search history.

(56) References Cited

U.S. PATENT DOCUMENTS 10,391,348 B2 * 8/2019 Gibson ..... A63B 21/00072
11,426,617 B2 * 8/2022 Petrillo ..... A63B 21/225
11,883,718 B2 * 1/2024 Lee ..... A63B 21/0056

* cited by examiner

*Primary Examiner* — Megan Anderson

(57) ABSTRACT

A resistance adjustment device of an exercise apparatus include a metal disc that can be driven by movement of a user, a bracket that can be controlled by the user and at least one magnet disposed on the bracket. The magnet can be movable along an adjustment path to approach or move away from a rotation axis of the metal disc so as to increase or decrease a projection area of the magnet on the metal disc for adjusting rotational resistance of the metal disc. The magnet has an irregular quadrilateral cross section gradually widening from a front side closer to the rotation axis to a rear side farther away from the rotation axis, so that during the period of the magnet moving along the adjustment path to approach the rotation axis at a constant speed, the increase rate of the projection area will be gradually accelerated.

17 Claims, 9 Drawing Sheets

RESISTANCE ADJUSTMENT DEVICE OF EXERCISE APPARATUS

BACKGROUND

1. Field of the Invention

The present invention relates to an exercise apparatus. More particularly, the present invention relates to a resistance adjustment device of the exercise apparatus.

2. Description of the Related Art

FIG. 1 shows a prior art exercise bike 90, more specifically a so-called "spinning bike" that is popular recently, which can be used indoors by users to simulate riding a road bike. When the user pedals a pedal crank assembly 91 of the exercise bike 90, a metal disc 93 will be driven to rotate in place through a transmission system 92. Such metal disc 93 has the function of a flywheel, that is, it can generate sufficient rotational inertia when rotating so as to enable the pedal crank assembly 91 to rotate smoothly and accelerate or decelerate the rotational speed smoothly. Furthermore, the exercise bike 90 has a resistance adjusting device 94 being operable to adjust rotation resistance of the metal disc 93, commonly known as an eddy current brake, so that the user can adjust the resistance against pedaling movement according to their needs.

FIG. 2 shows a typical structure of the aforementioned resistance adjusting device 94, which has a bracket 95 that can swing within a predetermined angular range according to a swing axis A1. The user can rotate an adjusting lever 96 on the front end of the exercise bike 90 (as shown in FIG. 1) to control the position of the bracket 95 by shortening or lengthening a steel cable 97 that is connected to the bracket 95. When adjusting, the displacement amount of the bracket 95 is proportional to the displacement amount of the adjusting lever 96. The bracket 95 has two round-shaped magnets 98 respectively located at two opposite sides of the metal disc 93. As shown in FIG. 2, the two magnets 98 are axially overlapped, and only one magnet 98 will be used for the following illustration. The magnet 98 can be moved with the movement of the bracket 95 across the circular edge 931 of the metal disc 93 along an adjustment path T1 to approach or move away from the rotation axis of the metal disc 93, so that the projection area of the magnet 98 on the metal disc 93 can be increased or decreased. The aforementioned projection area can be understood as the effective area where the magnet 98 causes eddy currents induced in the metal disc 93. In brief, at the same rotational speed, the resistance of the magnet 98 against rotation of the metal disc 93 is proportional to the aforementioned projection area.

Referring to FIG. 2, when the magnet 98 is located at one end (the left end in in the figure) of the adjustment path T1 farther away from the rotation axis of the metal disc 93, as shown by the phantom line 98' at the outer critical position, the circular edge of the magnet 98 and the circular edge 931 of the metal disc 93 are externally tangent. Since the aforementioned projection area is zero and cannot be smaller, the resistance applied by the magnet 98 to the metal disc 93 is at the minimum value of the adjustable range. In contrast, when the magnet 98 is located at the other end (the right end in in the figure) of the adjustment path T1 closer to the rotation axis of the metal disc 93, as shown by the phantom line 98" at the inner critical position, the circular edge of the magnet 98 and the circular edge 931 of the metal disc 93 are internally tangent. Since the aforementioned projection area is equal to equal to the circular cross sectional area of the magnet 98 and cannot be larger, the resistance applied by the magnet 98 to the metal disc 93 is at the maximum value of the adjustable range. It is conceivably that when the magnet 98 is operated to move from the outer critical position to the inner critical position, the aforementioned projection area will be gradually increased from zero to equal to the circular cross sectional area of the magnet 98, and the aforementioned resistance will be gradually increased from the minimum value to the maximum value of the adjustable range.

However, in the conventional resistance adjusting device disclosed above, when the user controls the position of the magnet 98 on the adjustment path T1 by rotating the adjusting lever 96 to adjust the exercise resistance, there may be a gap between the expected resistance change and the actual resistance change. FIG. 3 shows a sequential change of the multiple levels of the magnet 98 from the outer critical position to the inner critical position, and the magnet positions in the multiple levels are equally spaced. Specifically, the minimum resistance is set to Lv.0, and the maximum resistance is set to Lv.10. That is, it can stepwise move 10 levels from the lowermost level to the uppermost level. Assuming that the difference of the magnet positions between Lv.10 and Lv.0 is 60 degrees (namely the angular position of the magnet 98 relative to the swing axis A1), the magnet positions of every adjacent two levels are 6 degrees apart. As shown in FIG. 3, the black area of each level represents the overlapping area of the magnet 98 and the metal disc 93 in the axial direction. Obviously, every time the magnet 98 advances a level, the overlapping area (i.e. the aforementioned projection area) will be increased a little bit more, so that the resistance will be increased accordingly. However, since the cross section of the magnet 98 is circular, during the period of the magnet 98 moving from the outer critical position (Lv.0 position) to the inner critical position (Lv.10 position) at a constant speed, the increase rate of the projection area will be gradually speeded up in the first half of the period and gradually slowed down in the second half of the period. As shown in FIG. 4, when the magnet 98 is located at the Lv.0 position, no part of the circular cross section of the magnet 98 overlaps the metal disc 93. When the magnet 98 is located at the Lv.1 position, a small area (a1) at the edge of the circular cross section of the magnet 98 overlaps the metal disc 93. When the magnet 98 advances from the Lv.1 position to the Lv.2 position, the overlapping area of the cross section of the magnet 98 and the metal disc 93 will increase additional slightly larger area (b2). Therefore, every time the magnet 98 advances a unit distance (e.g. swinging 6 degrees), the overlapping area will increase a little bit more, and the increased area of each level will be larger and larger, for example, a3 is larger than a2, a4 is larger than a3, and so on. But, after about half of the circular cross section of the magnet 98, every time the magnet 98 advances a unit distance, the overlapping area of each level will be decreased, namely the increased area of each level will be smaller and smaller, for example, a8 is smaller than a7, a9 is smaller than a8, and finally a10 is smaller than a9.

FIG. 5 is a graph showing the relationship between the aforementioned overlapping area and the position of the magnet 98. The abscissa of the graph represents the position of the magnet 98, marking ten equal positions corresponding to the multiple levels. The ordinate of the graph represents the overlapping area, taking the cross section of the magnet 98 as 100% (namely the maximum value of the projection area), marking the percentage of the overlapping area at each level relative to the maximum value, which also represents the percentage of the resistance that the magnet 98 applies to the metal disc 98 relative to the maximum resistance that may be applied. As the data shown FIG. 5, when the resistance level changes from Lv.0 to Lv. 6, every time the magnet 98 is operated to advance a level, the resistance increases in the order of 3.0%, 6.0%, 8.5%, 10.6%, 12.3%, and 13.5% of the maximum resistance, showing that the resistance increase rate is gradually accelerated; when the resistance level changes from Lv.6 to Lv. 10, every time the magnet 98 is operated to advance a level, the resistance increases in the order of 14.0%, 13.5%, 11.7%, and 6.9% of the maximum resistance, showing that the resistance increase rate is gradually decelerated. As shown in the graph of FIG. 5, the slope of the central line segment is relatively high, and the slopes of the lower and upper line segments are relatively low, which means that the aforementioned resistance responds relatively sensitively to the change of the magnet position in the middle of the adjustable range, and the response is relatively insensitive in the front and rear regions of the adjustable range. According to the proportional relationship shown in FIG. 5, the magnet needs to advance form the outer critical position to approximately 32.8% of the total length of the adjustment path T1 to increase the resistance from zero to 20% of the maximum resistance. After that, to increase the resistance form 20% to 40%, from 40% to 60%, and from 60% to 80% of the maximum resistance, the magnet only needs to advance about 17.0%, 14.7%, and 14.6% of the total length of the adjustment path T1 respectively. Finally, to increase the resistance from 80% to 100% of the maximum resistance, the magnet needs to advance about 21.1% of the total length of the adjustment path T1, and such adjustment efficiency (referring to the ratio of resistance change to displacement distance) becomes lower again.

Accordingly, the conventional resistance adjusting device as mentioned above may cause the user to feel the incoordination between the resistance change and the adjustment motion when the user wants to adjust the exercise resistance, especially the exercise apparatus like the aforementioned spinning bike that is often used for high intensity interval training. Since the user may frequently increase and decrease the exercise resistance during exercise, and the variation range is quite large, it is easy to feel the same adjustment motion (such as rotating the adjusting lever 96 by the same angle, or an adjustment level), the resistance change at the middle resistance is more obvious than the resistance changes at low resistance and high resistance, and the operation response has neither linear nor uniform trend. Therefore, the magnitude of the resistance change may be less than the user's expectations and needs.

The present invention has arisen to mitigate and/or obviate the disadvantages of the conventional method. Further benefits and advantages of the present invention will become apparent after a careful reading of the detailed description with appropriate reference to the accompanying drawings.

SUMMARY

The present invention is directed to a resistance adjustment device of an exercise apparatus. When the user of the exercise apparatus adjusts the exercise resistance, the resistance adjustment device has a uniform trend and predictability in the operation response, so the user experience is better.

According to one aspect of the present invention, a resistance adjustment device of an exercise apparatus includes a frame, a metal disc, a bracket movably mounted on the frame, and at least one magnet disposed on the bracket. The metal disc is pivotally mounted on the frame about a rotation axis, and movement of a user of the exercise apparatus causing rotation of the metal disc. The magnet has a non-circular cross section defining a first edge and a second edge, and both the first edge and the second edge have a front end and a rear end. The two front ends are located at the same side and separated by a first distance. The two rear ends are located at the other side and separated by a second distance greater than the first distance. The cross section of the magnet has a width between the first edge and the second edge. Specifically, the width of the magnet is gradually enlarged from a front side where the two front ends are located to a rear side where the two rear ends are located. The magnet is movable along an adjustment path across an outer edge of the metal disc to approach or move away from the rotation axis along with movement of the bracket so as to increase or decrease an overlapping area of the magnet and the metal disc. When the magnet is located at a first end of the adjustment path, the overlapping area is at a minimum value within an adjustable range, and when the magnet is located at a second end of the adjustment path, the overlapping area is at a maximum value within the adjustable range.

Preferably, when the magnet is located at the first end of the adjustment path, at least one of the first edge and the second edge of the cross section of the magnet intersects the outer edge of the metal disc. During a period of the magnet moving along the adjustment path from the first end to the second end, the overlapping area increases at least 5% to 95% of a difference between the maximum value and the minimum value, and both the first edge and the second edge of the magnet are kept passing through the outer edge of the metal disc at the same time.

Preferably, the cross section of the magnet further has a short edge connecting the front ends of the first edge and the second edge and a long edge connecting the rear ends of the first edge and the second edge. When the magnet is located at the first end of the adjustment path, the short edge of the cross section approaches or overlaps the outer edge of the metal disc. When the magnet is located at the second end of the adjustment path, the long edge of the cross section approaches or overlaps the outer edge of the metal disc.

Preferably, the bracket is pivotally mounted on the frame about a swing axis parallel to the rotation axis. The orientation between the first edge and the second edge of the cross section of the magnet corresponds to the orientation between the magnet and the swing axis. Furthermore, the first edge of the cross section of the magnet is closer to the swing axis than the second edge, and the length of the second edge is greater than the length of the first edge.

Preferably, the at least one magnets includes two opposite magnets located at two opposite sides of the metal disc. Each magnet has an inner side with a shape corresponding to the cross section. The inner side of each magnet is parallel to the corresponding side of the metal disc and spaced apart by a distance, and the axial projections of the two magnets on the metal disc are overlapped with each other.

Further benefits and advantages of the present invention will become apparent after a careful reading of the detailed description with appropriate reference to the accompanying drawings.

DETAIL DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
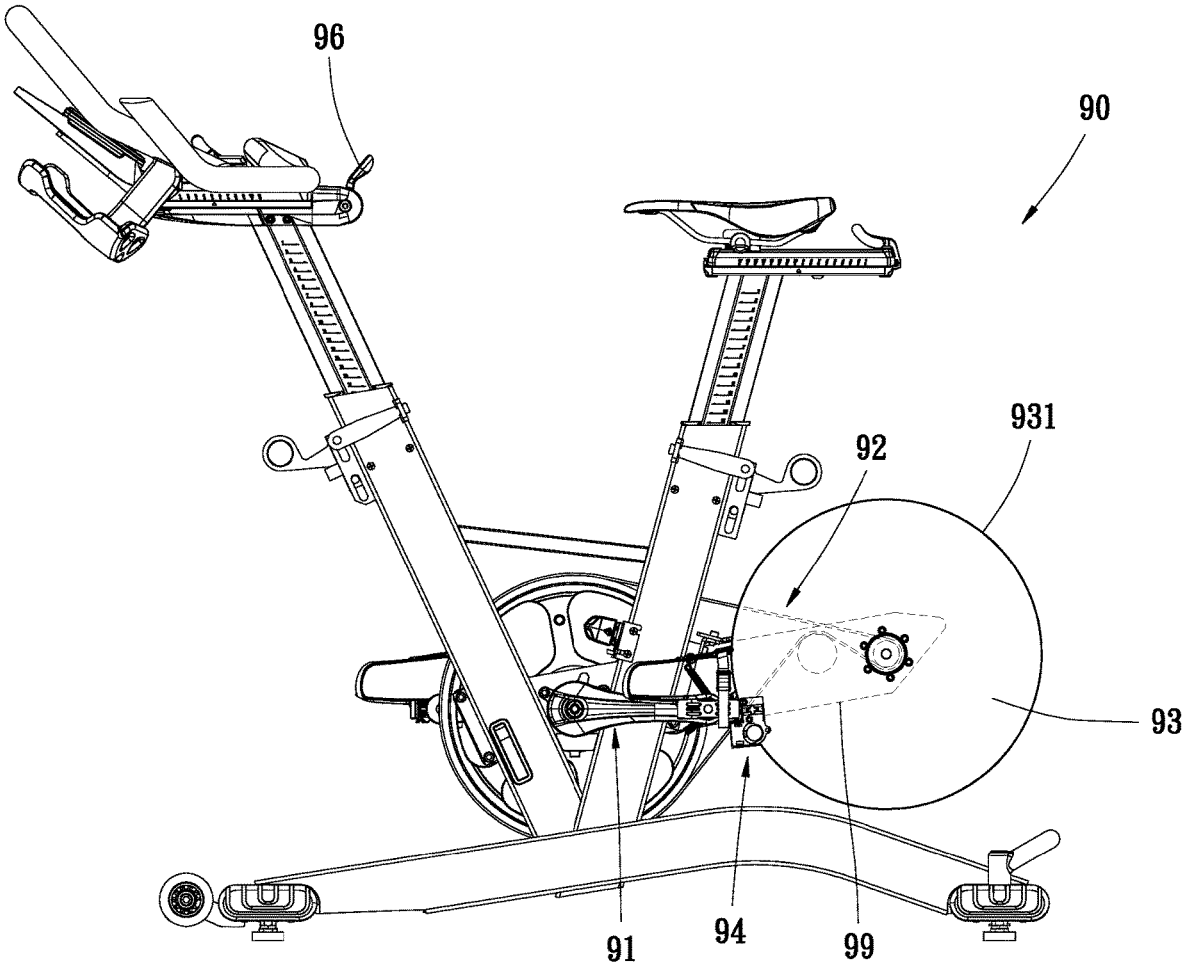
FIG. 1 (Prior art)
FIG. 1 is a side view of a conventional exercise bike.
Figure 2:
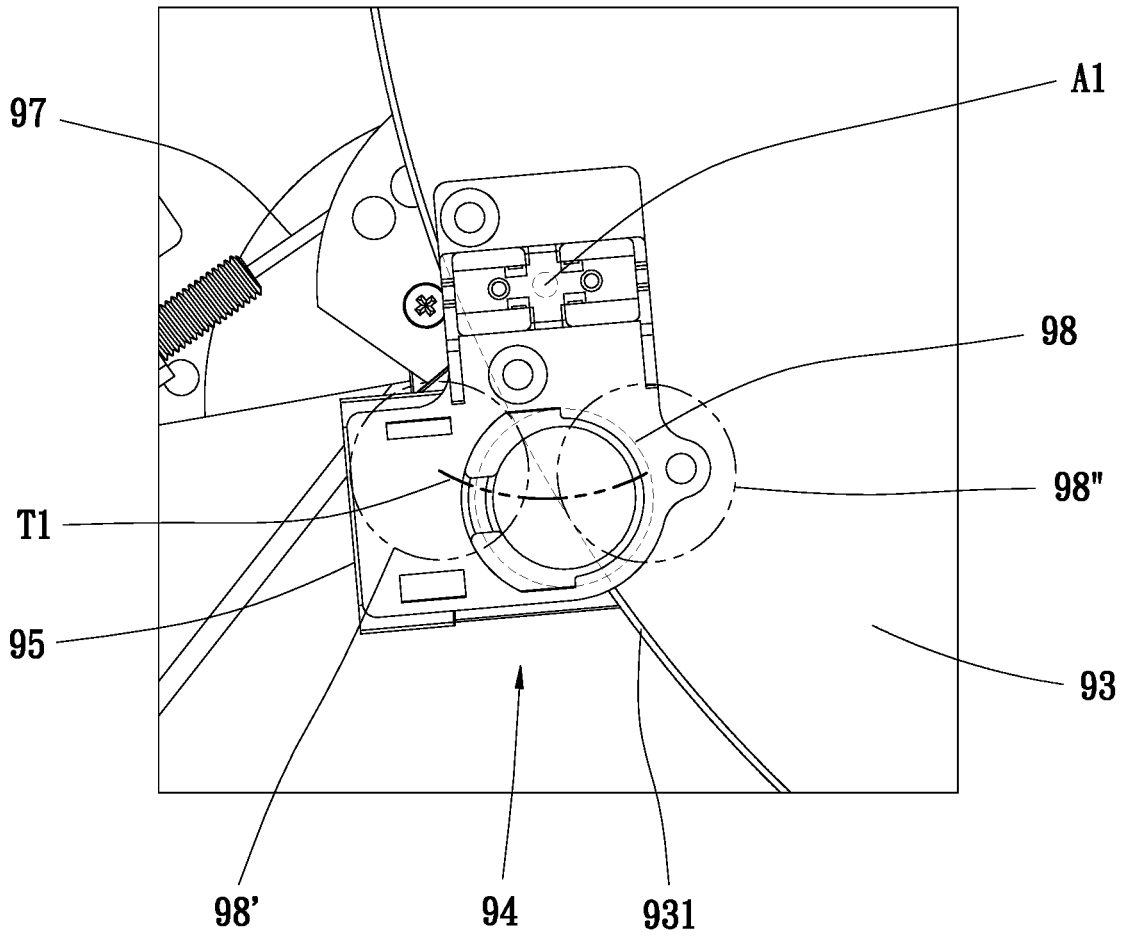
FIG. 2 (Prior art)
FIG. 2 is a partially enlarged view of a resistance adjustment device of the exercise bike shown in FIG. 1, showing an adjustment path of the magnet and the critical positions at two ends.
Figure 3:
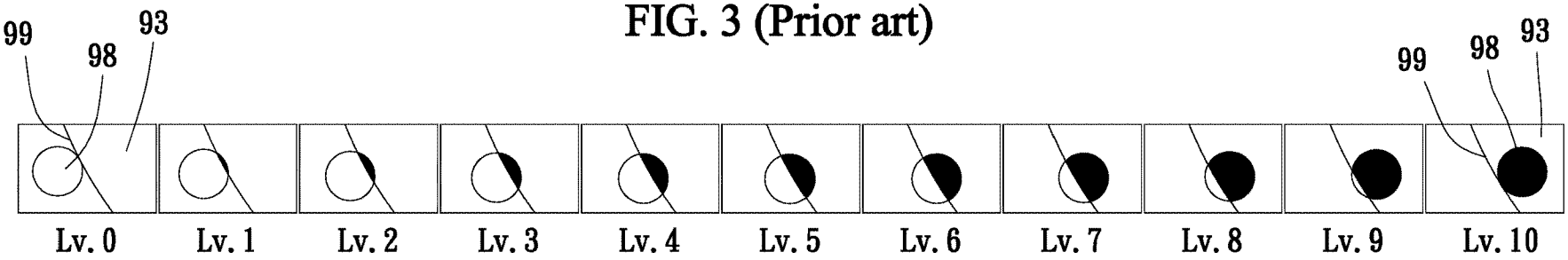
FIG. 3 (Prior art)
FIG. 3 shows a sequential change of multiple levels of the magnet shown in FIG. 2 from the outer critical position to the inner critical position, wherein each black area represents the overlapping area of the magnet and the metal disc.
Figure 4:
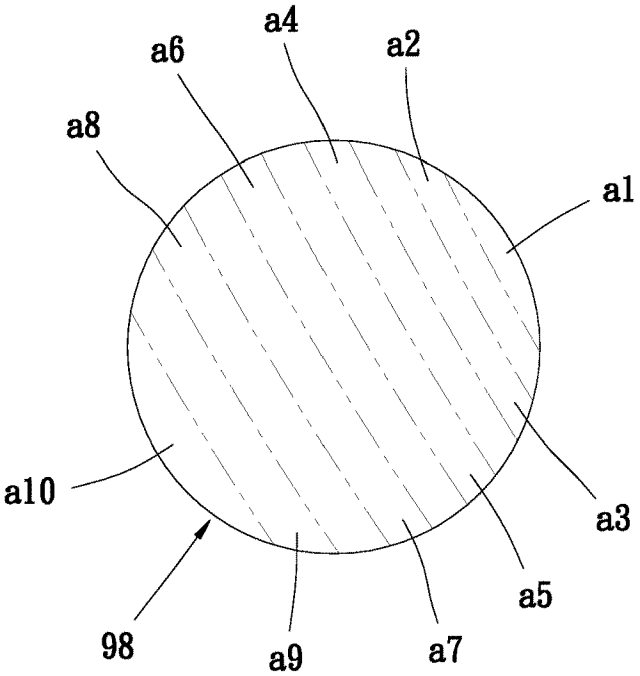
FIG. 4 (Prior art)
FIG. 4 shows the variation of the overlapping area of the magnet shown in FIG. 3 at each level.
Figure 6:
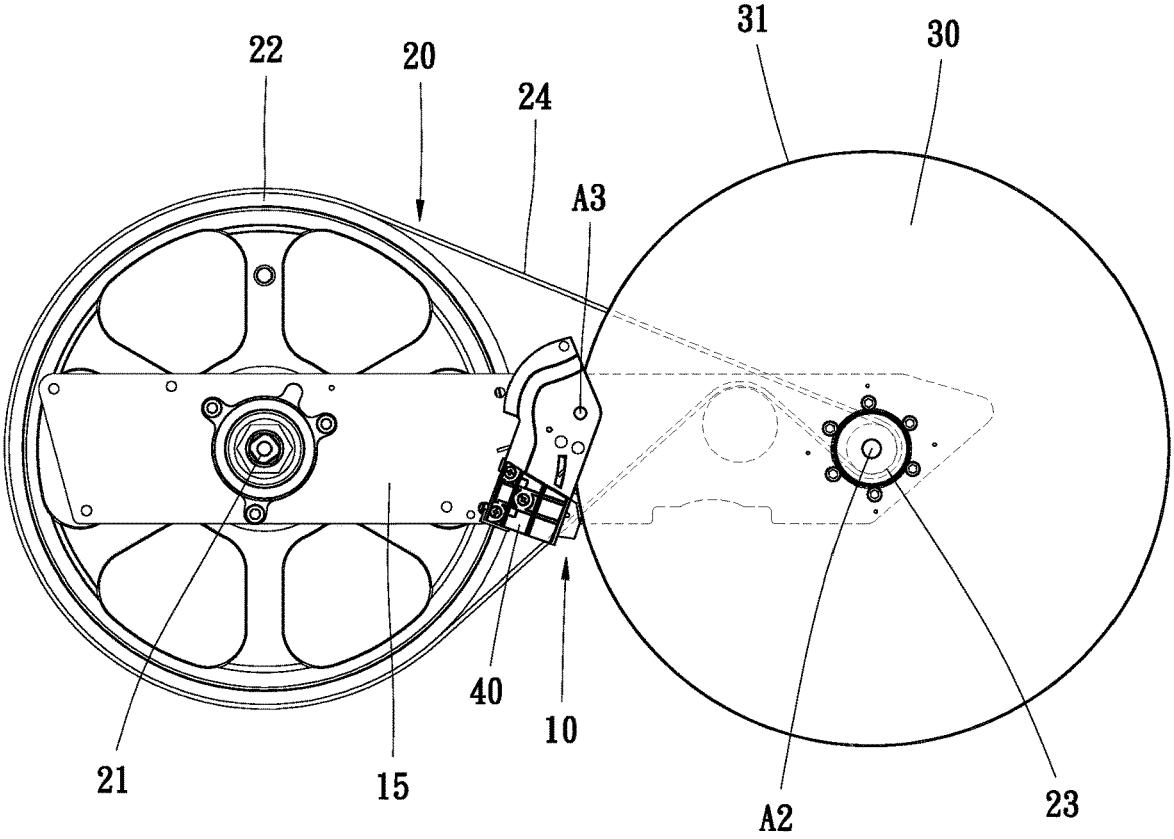
FIG. 6 is a side view of a resistance adjustment device and a transmission system of an exercise apparatus in accordance with a preferred embodiment of the present invention.
Figure 7:
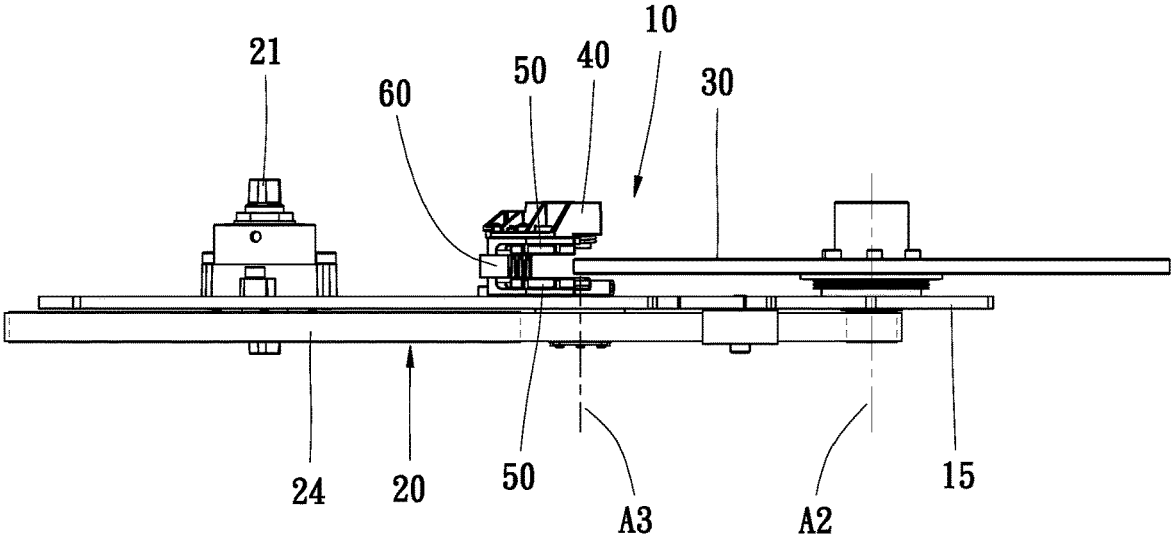
FIG. 7 is a bottom view of the resistance adjustment device and the transmission system shown in FIG. 6.

Referring to FIG. 6 and FIG. 7, a resistance adjustment device 10 is illustrated in accordance with a preferred embodiment of the present invention. The resistance adjustment device 10 is mounted on a transmission system 20 of an exercise apparatus. In order to compare with the prior art, the resistance adjustment device 10 of the present invention is also applied on the exercise bike as shown in FIG. 1, which can be provided for a user to adjust the resistance against pedaling movement according to their needs. It should be noted that the resistance adjustment device 10 of the present invention can also be applied to other types of exercise bikes such as upright bike or recumbent bike by similar embodiments or other appropriate assembly methods, and even exercise equipment other than the exercise bikes, including cardio exercise equipment (e.g. elliptical machines, steppers, rower machines), weight training machines, hybrid exercise equipment (e.g. the exercise apparatus with both functions of treadmill and weight training as shown in U.S. Pat. No. 10,398,933), and any other exercise equipment that can use eddy current brake to generate exercise resistance and provide for resistance adjustment.

In the preferred embodiment of the present invention, the resistance adjustment device 10 includes a circular plate-shaped metal disc 30 pivotally mounted on a frame 15 of the exercise apparatus according to a rotation axis A2 which passes through its center of circle and corresponds to the lateral direction of the exercise apparatus, so that the metal disc 30 can be rotated in place on the frame 15. The aforementioned frame 15 is generally a fixed metal frame of the exercise apparatus. For example, the frame 15 shown in FIG. 6 may correspond to the frame 99 which directly supports the pedal crank assembly 91 and the metal disc 93 as shown in FIG. 1. Like previous technology shown in FIG. 1, the metal disc 30 is integrally formed of aluminum material with a predetermined diameter and thickness, and the surface of the metal disc 30 is flat without hollows, which can generate sufficient rotational inertia while rotating. When the user uses the exercise apparatus to perform a specific exercise, the metal disc 30 can be driven to rotate by the user's movement.

In the preferred embodiment, the exercise movement of the user will be transmitted to the metal disc 30 through the aforementioned transmission system 20 in the form of torque. Specifically, the transmission system 20 includes a driving shaft 21, a large pulley 22, a small pulley 23 and a driving belt 24. The driving shaft 21 is pivotally mounted on the frame 15 corresponding to the lateral direction of the exercise apparatus. The large pulley 22 is coaxially connected to the driving shaft 21 and the small pulley 23 is coaxially connected to the metal disc 30. The driving belt 24 is mounted around the large pulley 22 and the small pulley 23, so that the exercise movement of the user (e.g. pedaling the pedals of the bike) will drive the driving shaft 21 (e.g. the crank shaft of the bike) to rotate, and the metal disc 30 will be driven to rotate at a higher rotational speed. In exercise equipment such as indoor bikes or elliptical machines, the aforementioned large pulley 22 is generally fixedly coupled to the driving shaft 21, and the small pulley 23 is also fixedly coupled to the metal disc 30. In other words, the driving shaft 21 and the metal disc 30 constitute a two-way transmission mechanism. For example, during exercise, the rotation of the driving shaft 21 causes the metal disc 30 to rotate, and the rotational inertia of the metal disc 30 also acts on the driving shaft 21, so that the driving shaft 21 can rotate smoothly and accelerate or decelerate the rotational speed smoothly. However, in the upright bike or recumbent bike, a one-way bearing is generally arranged between the large pulley 22 and the driving shaft 21, so that the pedals of the bike can be stopped arbitrarily or even reversed in the forward rotation movement without being affected by the aforementioned inertia force. The above transmission mechanism about the metal disc 30 can be driven to rotate by the movement of the user is a convention technique that are well known in the art.

Figure 8A:
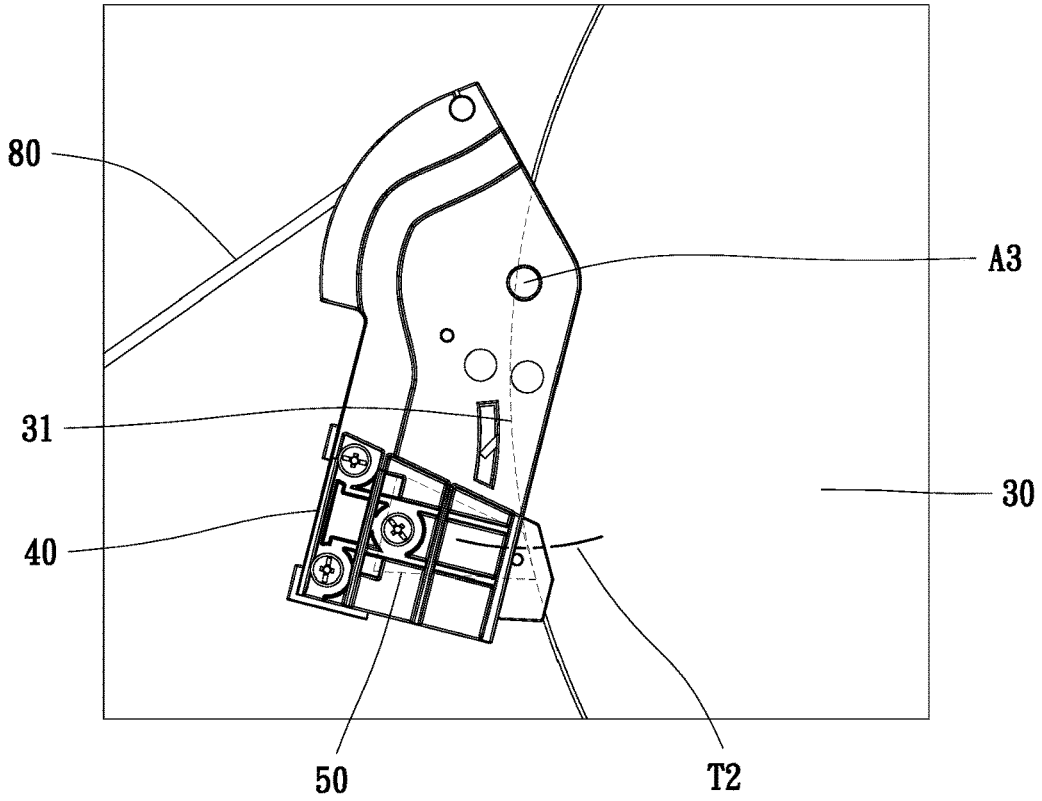
FIG. 8A is a partially enlarged view of the resistance adjustment device shown in FIG. 6, showing that the magnet is located at a first end of an adjustment path.
Figure 8B:
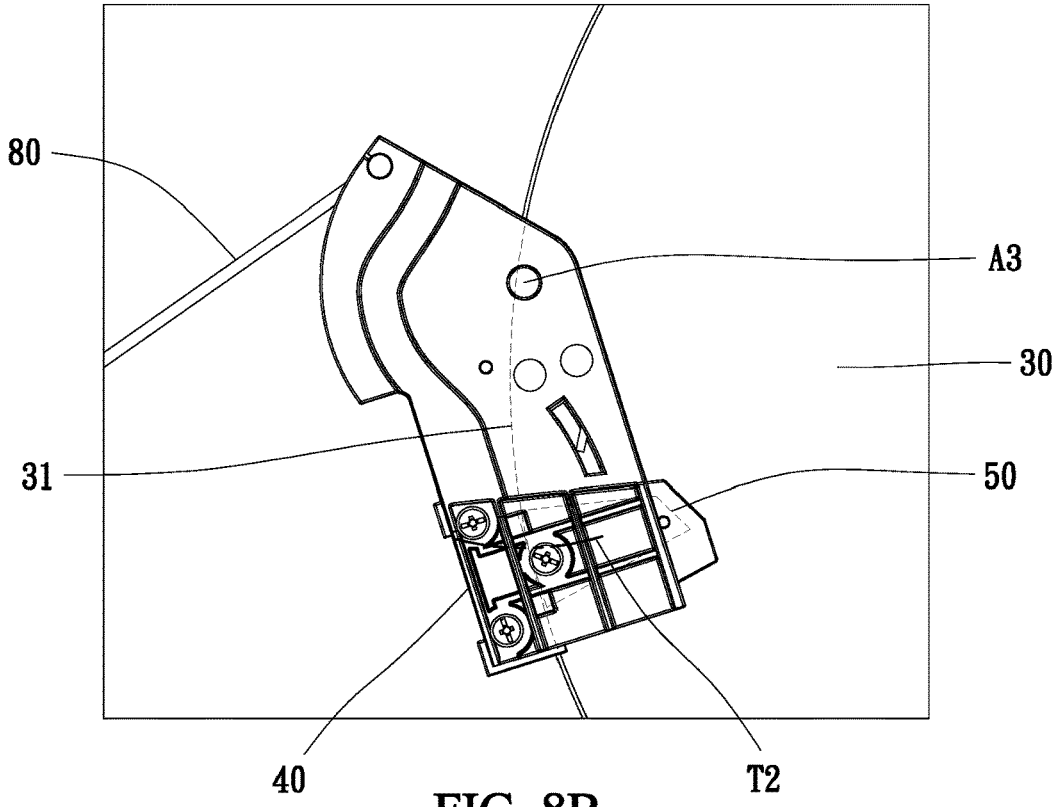
FIG. 8B is similar to FIG. 8A, showing that the magnet is located at a second end of the adjustment path.
Figure 9:
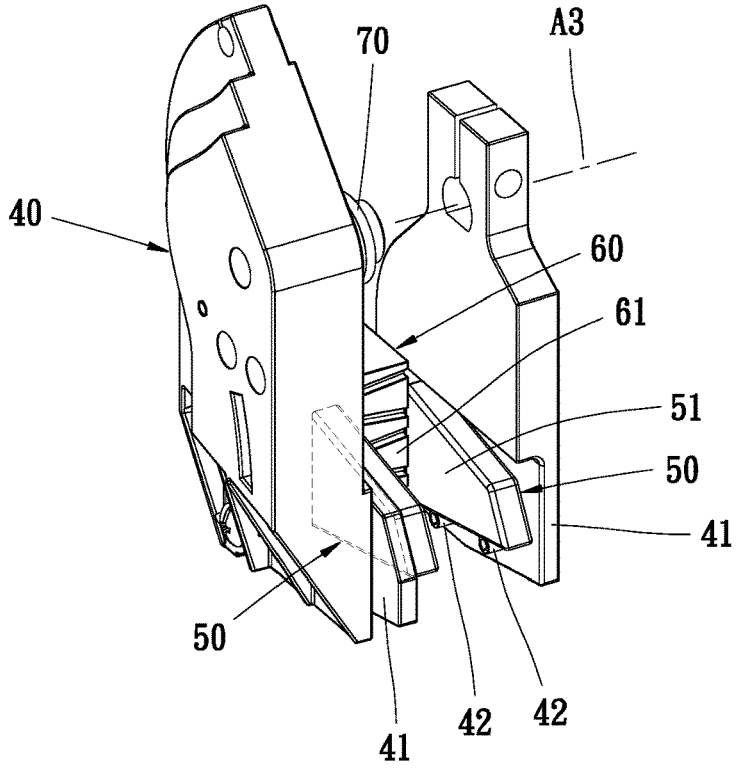
FIG. 9 is a perspective view of the resistance adjustment device shown in FIG. 6.
Figure 10:
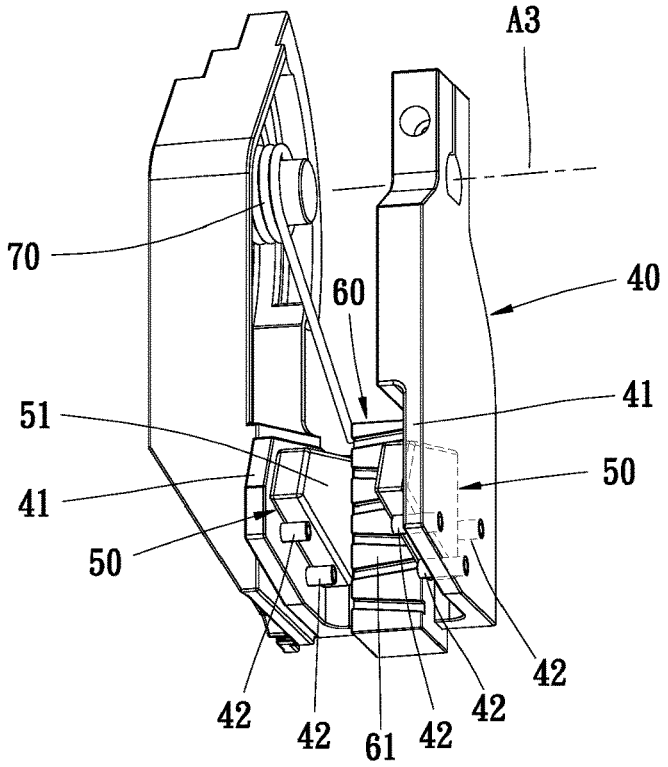
FIG. 10 is a perspective view of the resistance adjustment device shown in FIG. 9 viewed from another angle.

Referring to FIG. 8A and FIG. 8B, the resistance adjustment device 10 further has a bracket 40 near a round outer edge 31 of the metal disc 30 (i.e. the rim of the metal disc 30). The bracket 40 is movably mounted on the frame 15. In the preferred embodiment of the present invention, the bracket 40 is pivotally mounted on the frame 15 about a swing axis A3 corresponding to the lateral direction of the exercise apparatus, so that the bracket 40 can be rotatable within a predetermined angular range based on the user's control. For example, the bracket 40 can swing back and forth between the two positions shown in FIG. 8A and FIG. 8B and stop at a desired position. Referring to FIG. 9 and FIG. 10, a torsion spring 70 is mounted between the bracket 40 and the frame 15 for biasing the bracket 40 in a first rotational direction (e.g. clockwise direction in FIGS. 8A and 8B). That is, the elastic force of the torsion spring 70 can make the bracket 40 rotate in the first rotational direction with respect the frame 15. Referring to FIGS. 8A and 8B, a steel cable 80 has one end connected to the bracket 40 and the other end connected to an adjusting member (for example, the adjusting lever 96 shown in FIG. 1 or an adjusting knob). Specifically, the steel cable 80 may be connected to a winder (not shown, generally located near the console or handle assembly of the exercise apparatus), and the winder is connected to the adjusting member which can be rotated stepwise or steplessly within a predetermined adjustable range. When the user rotates the adjusting member by a displacement in a direction of increasing resistance, the steel cable 80 will be wound by the winder for a corresponding length, so that the bracket 40 is pulled by the steel cable 80 against the elastic force of the torsion spring 70 to rotate by a corresponding angle in a second rotational direction opposite to the first rotational direction (e.g. counterclockwise direction in FIGS. 8A and 8B). When the user rotates the adjusting member by a displacement in a direction of decreasing resistance, the winder will release the steel cable 80 for a corresponding length, so that the bracket 40 is forced by the torsion spring 70 to rotate by a corresponding angle in the first rotational direction. Briefly, within the predetermined adjustable range, the position of the adjusting member determines the position of the bracket 40. When adjusting, the displacement amount/displacement rate of the adjusting member and the displacement amount/displacement rate of the bracket 40 are maintained at a certain proportional relationship. For example, assuming that the adjustable range of the adjusting member is 200 degrees and the adjustable range of the bracket 40 is 50 degrees, then when the adjusting member is rotated 20 degrees in one rotational direction, the bracket 40 will be rotated 5 degrees in the corresponding rotational direction.

Referring to FIG. 9 and FIG. 10, the bracket 40 has two parallel side plates 41 opposite to each other, and a plate-shaped magnet 50 is attached to the inner side of the each side plate 41. The two magnets 50 are opposite to each other and respectively located at two sides of the metal disc 30, as shown in FIG. 7. The inner side 51 of each magnet 50 is parallel and close to the corresponding side of the metal disc 30. Each magnet 50 is spaced a distance apart from the metal disc 30, and the distance between each magnet 50 and the metal disc 30 remains unchanged even if the bracket 40 moves and/or the metal disc 30 rotates. In the preferred embodiment, the shape of the inner side 51 of each magnet 50 (corresponding to the cross-sectional shape of the magnet 50 with a cutting plane perpendicular to the rotation axis A2) is an irregular quadrilateral, not a parallelogram. The two magnets 50 have the same size and shape, and their positions and angles correspond to each other. Therefore, observed along the axial direction of the metal disc 30 as shown in FIGS. 8A and 8B, the cross sections of the two magnets 50 are entirely overlapped.

Figure 12:
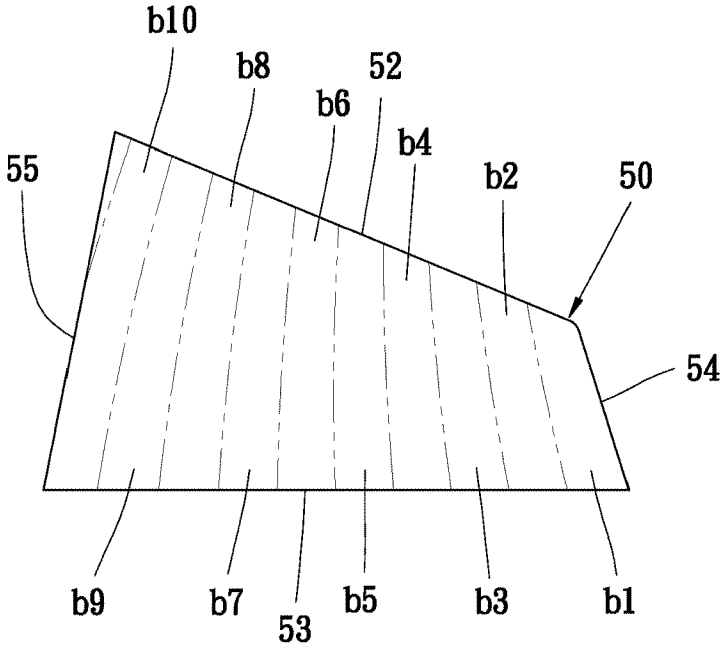
FIG. 12 shows the variation of the overlapping area of the magnet shown in FIG. 11 at each level.

As shown in FIG. 12, the outer edge of the cross section of each magnet 50 includes a first edge 52, a second edge 53, a short edge 54 and a long edge 55. The four edges 52-55 are straight lines and neither of them are parallel. The relative direction of the first edge 52 and the second edge 53 corresponds to the relative direction of the magnet 50 and the wing axis A3 (e.g. substantially longitudinal direction in the present embodiment). The first edge 52 is closer to the swing axis A3 than the second edge 53. In the preferred embodiment, each of the two magnets 50 is located below the swing axis A3, and the second edge 53 is located below the first edge 52. The length of the second edge 53 is greater than the length of the first edge 52. Both the first edge 52 and the second edge 53 have a front end and a rear end. The two front ends of the two edges 52, 53 are located at the same side (the right side in FIG. 12) and separated by a first distance. The two rear ends of the two edges 52, 53 are located at the other side (the left side in FIG. 12) and separated by a second distance which is greater than the first distance. As shown in FIG. 12, the cross section of each magnet 50 has a width between the first edge 52 and the second edge 53, and the width is gradually enlarged from a front side where the two front ends are located to a rear side where the two rear ends are located. The short edge 54 connects the front ends of the first edge 52 and the second edge 53, and the length of the short edge 54 is equal to the aforementioned first distance. The long edge 55 connects the rear ends of the first edge 52 and the second edge 53, and the length of the long edge 55 is equal to the aforementioned second distance.

As shown in FIG. 9 and FIG. 10, the bracket 40 has a plurality of positioning studs 42 transversely protruded from the inner side of each side plate 41. The bottom side of each magnet 50 (corresponding to the second edge 53) abuts against two of the positioning studs 42, and the rear side of each magnet 50 (corresponding to the long edge 55) abuts against the other one of the positioning studs 42 for allowing to quickly and precisely position the magnet 50 when assembling and to improve the stability of the magnet 50 on the bracket 40.

Referring to FIG. 8A and FIG. 8B, when the bracket 40 is controlled by the user to rotate according to the swing axis A3, the magnets 50 can be moved with the movement of the bracket 40 across the outer edge 31 of the metal disc 30 along an adjustment path T2. Therefore, the magnets 50 can be operated to approach or move away from the rotation axis A2 of the metal disc 30 within an adjustable range, so that the projection area of each magnet 50 on the metal disc 30 may be increased or decreased (as shown in FIGS. 8A and 8B, the viewing direction corresponds to the axial direction of the metal disc 30). Since the projections of the two magnets 50 on the metal disc 30 completely overlap with each other, the relationship between the position of each magnet 50 and the projection area is applicable to any magnet 50 thereafter, and the following only uses a single magnet for illustration. When the magnet 50 is located at one end of the adjustment path T2 farther away from the rotation axis A2 of the metal disc 30 (e.g. the left end in FIG. 8A, hereinafter referred to as a first end), the projection area is at a minimum value within the adjustable range. In contrast, when the magnet 50 is located at the other end of the adjustment path T2 closer to the rotation axis A2 of the metal disc 30 (e.g. the right end in FIG. 8B, hereinafter referred to as a second end), the projection area is at a maximum value within the adjustable range. In the preferred embodiment, when the magnet 50 is located at the first end, as shown in FIG. 8A, the magnet 50 as a whole is located outside the metal disc 30 and substantially adjacent to the outer edge 31 of the metal disc 30, and the aforementioned projection area is approximately zero. When the magnet 50 is located at the second end, as shown in FIG. 8B, the magnet 50 as a whole is located inside the metal disc 30 and substantially adjacent to the outer edge 31 of the metal disc 30, and the aforementioned projection area is approximately equal to the cross sectional area of the magnet 50.

More specifically, the relative direction of the short edge 54 and the long edge 55 (e.g. the long edge 55 to the short edge 54, and vice versa) corresponds to the moving direction of the magnet 50 approaching or moving away from the rotation axis A2 of the metal disc 30 along the adjustment path T2. In the preferred embodiment of the present invention, it is approximately the front-to-rear direction, that is, the left-right direction in FIGS. 8A and 8B, and the short edge 54 is closer to the rotation axis A2 of the metal disc 30 than the long edge 55.

When in magnet 50 is located at the first end of the adjustment path T2, the front ends of the first edge 52 and the second edge 53 of the cross section of the magnet 50 are closer to the outer edge 31 of the metal disc 30 than their rear ends. In other words, the narrow side of the cross section of the magnet 50 (i.e. the side where the short edge 54 is located) is closer to the outer edge 31 of the metal disc 30 than the wide side (i.e. the side where the long edge 55 is located). Additionally, at least one of the first and second edges 52, 53 intersects the outer edge 31 of the metal disc 30. For example, in the preferred embodiment of the present invention, the short edge 54 may approach or overlap the outer edge 31 of the metal disc 30, and the front end of the first edge 52 and/or the second edge 53 is precisely located on the outer edge 31, so that the aforementioned projection area is zero (or approaches zero) and, correspondingly, the resistance applied by the magnet 50 to the metal disc 30 is at the minimum value of the adjustable range. In another embodiment (not shown), when the magnet 50 is located at the first end of the adjustment path T2, both the front ends of the first edge 52 and the second edge 53 are located inside the outer edge 31 of the metal disc 30, that is, the narrow side of the cross section of the magnet 50 is partially located within the outer edge 31, so that the minimum value of the projection area is greater than zero.

In contrast, when the magnet 50 is locate at the second end of the adjustment path T2, the magnet 50 completely (or almost completely) overlaps the metal disc 30, and the long edge 55 of the cross section of the magnet 50 approaches or completely overlaps the outer edge 31 of the metal disc 30, so that the aforementioned projection area is equal to (or approximately equal to) the cross sectional area of the magnet 50 and, correspondingly, the resistance applied by the magnet 50 to the metal disc 30 is at the maximum value of the adjustable range. In practice, the cross sectional area of the magnet 50 can be compared with the circular cross sectional area of the conventional round disc magnet 98 in the prior art, such that the maximum resistance that the magnet 50 can exert on the metal disc 30 is equal to the maximum resistance in the prior art (assuming that the parameters such as specification of the metal disc, the thickness and material of the magnet are the same). Of course, the magnet size and the maximum resistance in the present invention can still be properly selected according the actual requirement. In another possible embodiment (not shown), when the magnet 50 is located at the second end the adjustment path T2, both the rear ends of the first edge 52 and the second edge 53 are located outside the outer edge 31 of the metal disc 30, that is, the wide side of the cross section of the magnet 50 is partially located outside the outer edge 31, so that the maximum value of the projection area is less than the cross sectional area of the magnet 50.

As shown in FIG. 9 and FIG. 10, in the preferred embodiment of the present invention, the bracket 40 further has a brake block 60 made of rubber material. The brake block 60 is fixed in between the two side plates 41 and located at the rear side of the magnets 50 farther away from the rotation axis A2 of the metal disc 30. The brake block 60 has a friction surface 61 facing the metal disc 30, and such friction surface 61 is aligned with the long edges 55 of the magnets 50. When the user controls the bracket 40 to swing in the second rotational direction until the two magnets 50 reaches the second end of the adjustment path T2, in addition to the two magnets 50 exerting the greatest resistance on the metal disc 30, the friction surface 61 of the brake block 60 will also contact the circumferential surface of the metal disc 30, directly resisting the rotation of the metal disc 30 by friction. The friction surface 61 of the brake block 60 may be completely or partially located within the cross sectional area of the magnet 50, or located completely outside the cross sectional area of the magnet 50. The aforementioned brake block 60 is mainly used for fast braking or preventing the rotation of the metal disc 30, especially suitable for exercise bikes. Conversely, some exercise equipment may not require the aforementioned friction block.

It should be note that, in order to ensure that the projection area of the magnet 50 can be adjusted to zero and/or to a maximum value equal the cross sectional area of the magnet 50, the displacement range of the magnet 50 may generally slightly exceed the positions shown in FIG. 8A and/or FIG. 8B. For example, in response to the user turning the aforementioned adjusting member (e.g. the adjusting lever 96), the bracket 40 may rotate slightly clockwise from the position shown in FIG. 8A, and/or rotate slightly rotate counterclockwise from the position shown in FIG. 8B, until the bracket 40 or the adjusting member is stopped by a preset retaining structure (not shown) or the friction surface 61 of the brake block 60 abuts against the circumferential surface of the metal disc 30. However, even if the magnet 50 is further away from the rotation axis A2 of the metal disc 30 from the position shown in FIG. 8A (i.e. the first end of the adjustment path T2), the projection area is still zero, not smaller. Similarly, even if the magnet 50 is further closer to the rotation axis A2 of the metal disc 30 from the position shown in FIG. 8B (i.e. the second end of the adjustment path T2), the projection area is still equal to the cross sectional area of the magnet 50, not larger. That is, only when the magnet 50 is displaced within the range of the adjustment path T2, the aforementioned projection area can be increased or decreased, namely the resistance applied by the magnet 50 to the metal disc 30 can be increased or decreased, thereby producing the effect of adjusting the resistance. In fact, the range of the adjustment path T2 is defined by two critical positions where the magnet 50 can exert the minimum resistance and the maximum resistance on the metal disc 30. Basically, the "adjustable range" of the magnet 50 or the bracket 40 (such as 50 degrees in the previous example) corresponds to the adjustment path T2, rather than the practical possible displacement range; and the "adjustable range" of the adjusting member used to control the bracket 40 and the magnet 50 (such as 200 degrees in the previous example) is also the same.

It is conceivable that when the adjusting member is located at one end of the adjustable range, the magnet 50 is correspondingly located at the first end of the adjustment path T2; in contrast, when the adjusting member is located at the other end of the adjustable range, the magnet 50 is correspondingly located at the second end of the adjustment path T2. Beside, when the adjusting member is operated to move from one end to the other end of the adjustable range, the magnet 50 will also synchronously move from the first end to the second end of the adjustment path T2. In brief, the position of the magnet 50 in the adjustment path T2 reflects the position of the adjusting member in its adjustable range at any time.

Figure 11:
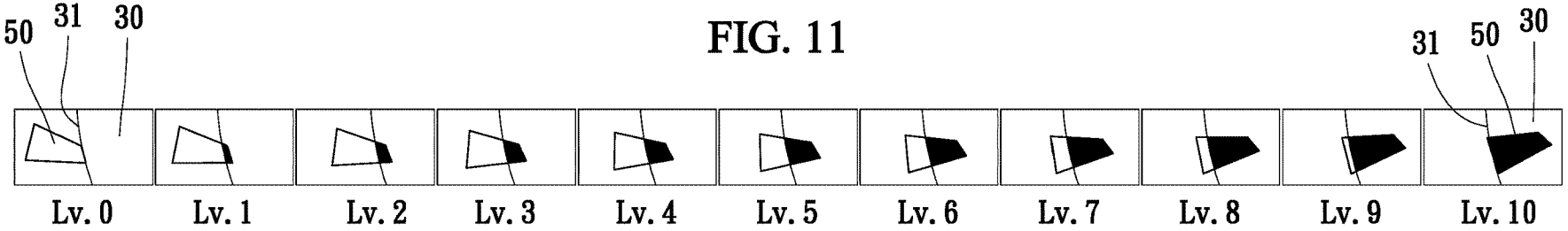
FIG. 11 shows a sequential change of multiple levels of the magnet shown in FIGS. 8A and 8B from a first end to a second end of the adjustment path, wherein each black area represents the overlapping area of the magnet and the metal disc.

FIG. 11 shows a sequential change of multiple levels of the magnet 50 between the first end and the second end of the adjustment path T2. The magnet positions in the multiple levels are equally spaced. Specifically, the minimum resistance is set to Lv.0, and the maximum resistance is set to Lv.10. Assuming that the adjustable range of the magnet 50 (namely the radian of the arc-shaped adjustment path T2) is 50 degrees, the magnet positions of every adjacent two of the multiple levels are 5 degrees apart. For example, if the adjusting member is rotated one-tenth of the full length of its adjustable range (e.g. 20 degrees out of 200 degrees), the magnet 50 will also move one-tenth of the full length of its adjustable range, such as advancing from the position of Lv.0 to the position of Lv.1. If the adjusting member is rotated half of the full length of its adjustable range, the magnet 50 will also move half of the full length of its adjustable range, such as advancing from the position of Lv.0 to the position of Lv.5.

As shown in FIG. 11, the black area of each level represents the overlapping area of the magnet 50 and the metal disc 30 in the axial direction. FIG. 12 shows the variation of the overlapping area of the magnet 50 at each level. When the magnet 50 is located at the Lv.0 position, no part of the cross section of the magnet 50 overlaps the metal disc 30. When the magnet 50 is located at Lv.1 position, a small area (b1) at the side where the short edge 54 is located will overlap the metal disc 30. When the magnet 50 advances from the Lv.1 position to the Lv.2 position, the overlapping area of the cross section of the magnet 50 and the metal disc 30 will increase a slightly larger area (b2), and so on. That is, when the magnet 50 sequentially advances to Lv.3, Lv.4, Lv.5 . . . , Lv.10 positions, the overlapping area will sequentially increase b3, b4, b5 . . . , b10 areas until the overlapping area is equal to the cross section of the magnet 50.

As shown in FIG. 12, the width of the aforementioned ten areas from b1 to b10 are substantially equal, but the height (or longitudinal lengths) is gradually increased from the length of b1 which is substantially equal to the length of the short edge 54 to the length of b10 which is substantially equal to the length of the long edge 55. Obviously, every time the magnet 50 advances a unit distance (e.g. swinging 5 degrees), the overlapping area of the cross section of the magnet 50 and the metal disc 30 will increase a little bit more. The augmented area in each level is magnified sequentially from Lv.0 to Lv.10. For example, the area b2 is larger than b1, b3 is larger than b2, b4 is larger than b3 . . . , and the last area b10 is also larger than the previous b9. It should be noted that the highest level is set to Lv.10 above, and the cross section of the magnet 50 is divided into ten small pieces according to the number of levels, which is only a simple example for illustration but not limited in the present invention. In practice, the rotation of the adjusting member (e.g. the adjusting lever 96) used to control the movement of the magnet 50 may be a multi-step rotation such as 16 levels, 20 levels, 24 levels, etc.; or the rotation of the adjusting member may be a stepless rotation, namely it can be rotated at any angle and stopped at any position within the adjustable range. In other words, the controlled displacement of the magnet 50 does not have a specific unit distance. In short, when the magnet 50 is moved along the adjustment path T2 from the first end to the second end, the overlapping area of the magnet 50 and the metal disc 30 is enlarged from the narrow side of the cross section of the magnet 50 (i.e. the side where the short edge 54 is located) toward the wide side (i.e. the side where the long edge 55 is located), so the increase rate of the aforementioned projection area is gradually accelerate.

Figure 5:
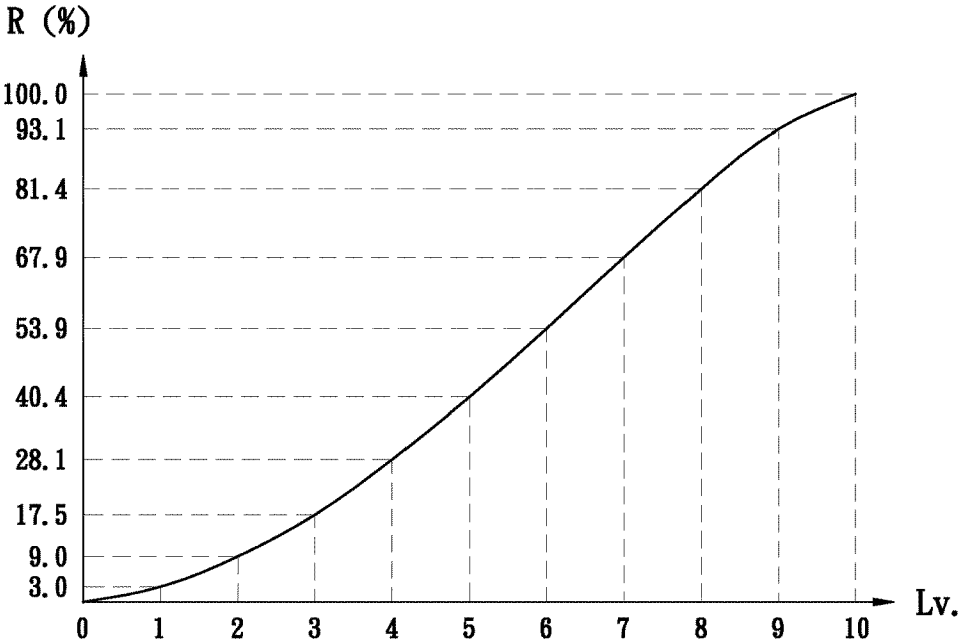
FIG. 5 (Prior art)
FIG. 5 is a graph showing a relationship between the position of the magnet and the overlapping area shown in FIG. 3.
Figure 13:
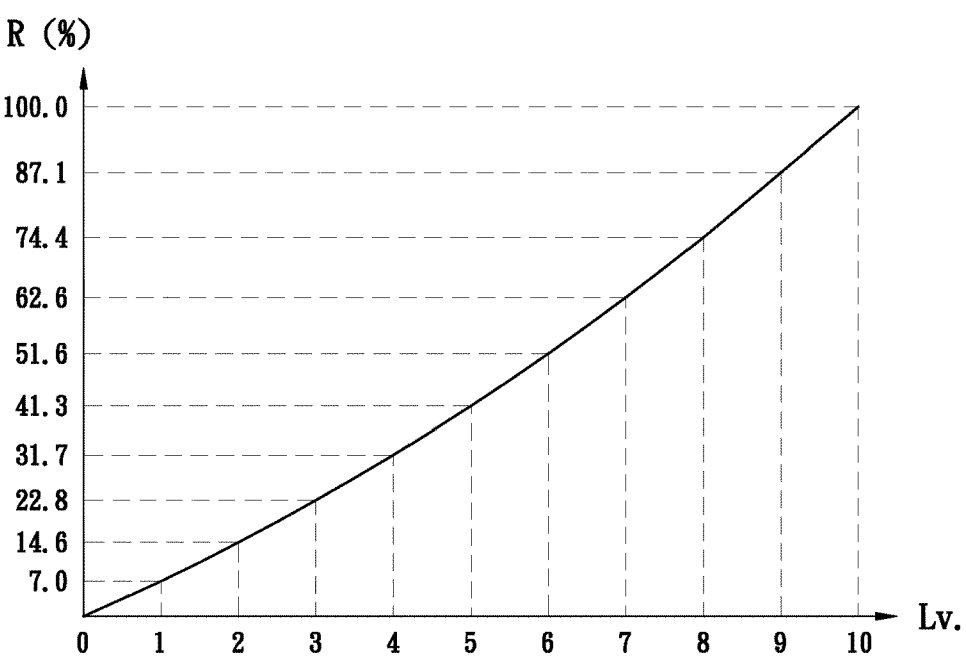
FIG. 13 is a graph showing a relationship between the position of the magnet and the overlapping area shown in FIG. 11.

FIG. 13 is a graph showing the relationship between the aforementioned projection area and the position of the magnet 50. Similar to FIG. 5, the abscissa in FIG. 13 represents the position of the magnet 50, marking ten equal positions corresponding to the multiple levels; and the ordinate represents the projection area, taking the cross section of the magnet 50 as the maximum value, marking the percentage of the projection area at each level relative to the maximum value, which also represents the percentage of the resistance that the magnet applies to the metal disc 30 relative to the maximum resistance that may be applied. As the data shown in FIG. 13, from Lv.0 to Lv.10, every time the magnet 50 is operated to advance one level (i.e. one tenth of the total length of the adjustment path T2), the resistance increases in the order of 7.0%, 7.6%, 8.2%, 8.9%, 9.6%, 10.3%, 11.0%, 11.8%, 12.7% and 12.9% of the maximum resistance, showing that the resistance increase rate is gradually accelerated.

In the resistance adjustment device 10 of the present invention, the inner side 51 of the magnet 50 toward the metal disc 30 (corresponding to the cross section of the magnet 50) is designed into a specific geometric shape, and arranging the magnet 50 and the metal disc 30 in a specific relationship (e.g. when the magnet 50 moves along the adjustment path T2, the changes of the position and angle of the cross section of the magnet 50 relative to the metal disc 30), so that during the period of the magnet 50 moving along the adjustment path T2 from the first end to the second end at a constant speed, the increase rate of the projection area of the magnet 50 on the metal disc 30 is gradually accelerated as a whole, that is, the increase rate of the resistance applied to the metal disc 30 is gradually accelerated. Specifically, during the period of the magnet 50 moving along the adjustment path T2 from the first end to the second end at a constant speed (at least at the period of the projection area increases from 5% to 95% of the difference between the maximum value and the minimum value), the outer edge of the metal disc 30 remains through the first edge 52 and the second edge 53 of the cross section of the magnet 50, namely both the first edge 52 and the second edge 53 are kept passing through the outer edge of the metal disc 30 at the same time. For example, the magnet 50 may slightly overlap the metal disc 30 about 5% of the cross sectional area of the magnet 50 to defined the minimum resistance level (e.g. Lv.0), and overlap the metal disc 30 about 95% of the cross sectional area of the magnet 50 to defined the maximum resistance level (e.g. Lv.10).

Under this arrangement, with the aforementioned resistance adjustment device of the present invention, when the user of the exercise apparatus adjusts the exercise resistance, the resistance adjustment device has a uniform trend and predictability in the operation response, so the user experience is better.

Figure 14:
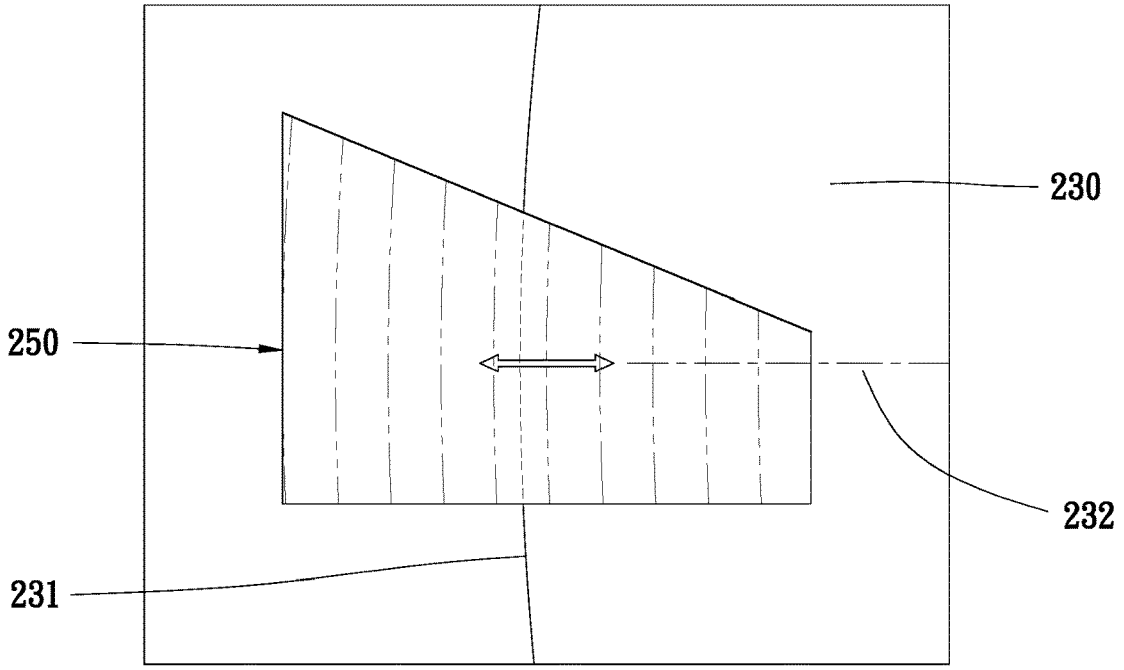
FIG. 14 shows the shape and displacement direction of a magnet in another possible embodiment of the present invention.

FIG. 14 shows another possible embodiment of the present invention, which is similar to the aforementioned embodiment, except that the cross section of the magnet 250 is shaped as a trapezoid, and its outer edge includes a first edge (the top side in the figure) and a second edge (the bottom side in the figure) that are opposite but not parallel, and a short edge (the right side in the figure) and a long edge (the left side in the figure) that are opposite and parallel. Furthermore, when adjusting the resistance, the magnet 250 can be operated to move along the radial direction 232 of the metal disc 230 across the outer edge 231 of the metal disc 230 to approach or move away from the rotation axis of the metal disc 230 (not shown), so that the projection area of the magnet 250 on the metal disc 230 can be increased or decreased. The relative direction of the short edge and the long edge of the cross section of the magnet 250 corresponds to the moving direction of the magnet 250 approaching or moving away from the rotation axis of the metal disc 230, and the short edge is closer to the rotation axis of the metal disc 230 than the long edge. Thereby, when the magnet 250 moves toward the rotation axis of the metal disc 230, the overlapping area of the magnet 250 and the metal disc 230 is enlarged from the narrow side of the cross section of the magnet 250 toward the wide side, so that the increase rate of the projection area of the magnet 250 on the metal disc 230 is gradually accelerated, that is, the increase rate of the resistance applied to the metal disc 230 is gradually accelerated.

Figure 15:
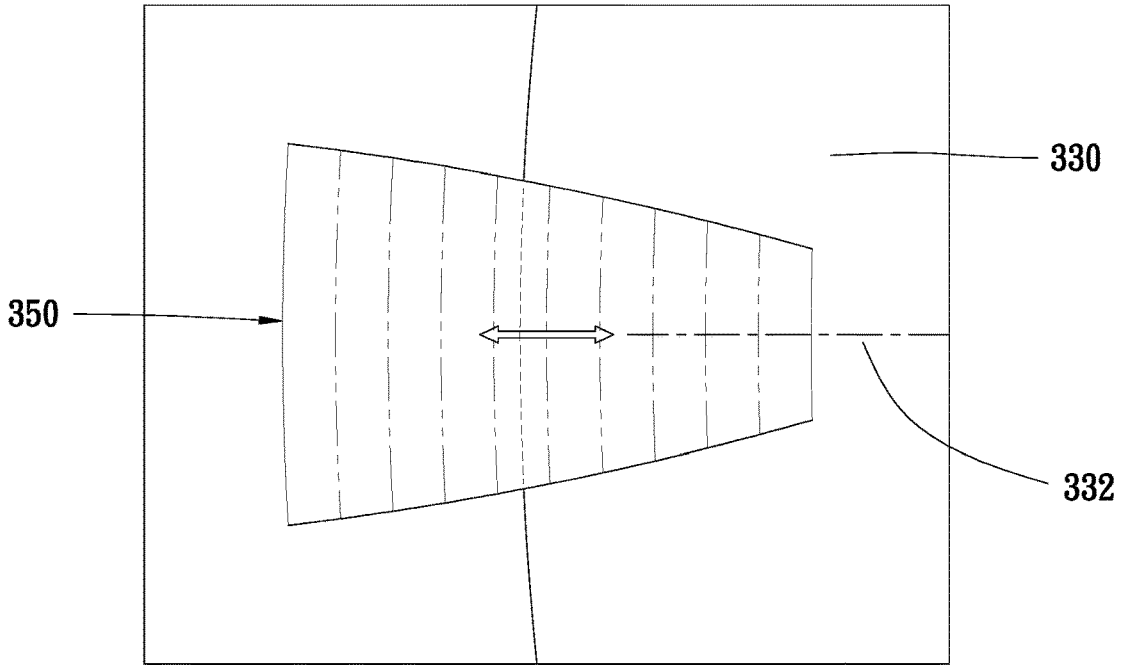
FIG. 15 shows the shape and displacement direction of a magnet in the other possible embodiment of the present invention.

FIG. 15 shows another possible embodiment of the present invention, which is similar to the aforementioned embodiment, except that the cross section of the magnet 350 is approximately trapezoidal, but the four sides of its outer edge are not straight lines. For example, the first edge (the top side in the figure) and a second edge (the bottom side in the figure) are both convex arcs that are curved outwards (as shown in the figure), or the edges may be concave arcs that are curved inwards. Nevertheless, the width between the first edge and the second edge is gradually enlarged from the side where the short edge is located (the right side in the figure) to the side where the long edge is located (the left side in the figure). Similarly, when the magnet 350 moves toward the rotation axis of the metal disc 330, the overlapping area of the magnet 350 and the metal disc 330 is enlarged from the narrow side of the cross section of the magnet 350 toward the wide side, so that the increase rate of the resistance applied to the metal disc 330 is gradually accelerated.

In another possible embodiment (not shown), when the resistance is at the minimum value of the adjustable range, namely the magnet is located at the first end of the adjustment path, neither the first edge nor the second edge intersects the outer edge of the metal disc. Instead, the outer edge of the metal disc may intersect with the short edge that may be a convex arc connecting the first edge and the second edge.

In the present invention, it may possible to user a motor or a linear actuator to drive the movement of the magnet. The user may also control the movement of the magnet through the electronic operation interface. For example, every time the button "+" (representing increasing resistance) is pressed, the magnet will be controlled to advance one level, and every time the button "−" (representing reducing resistance) is pressed, the magnet will be controlled to recede one level.

Figure 16:
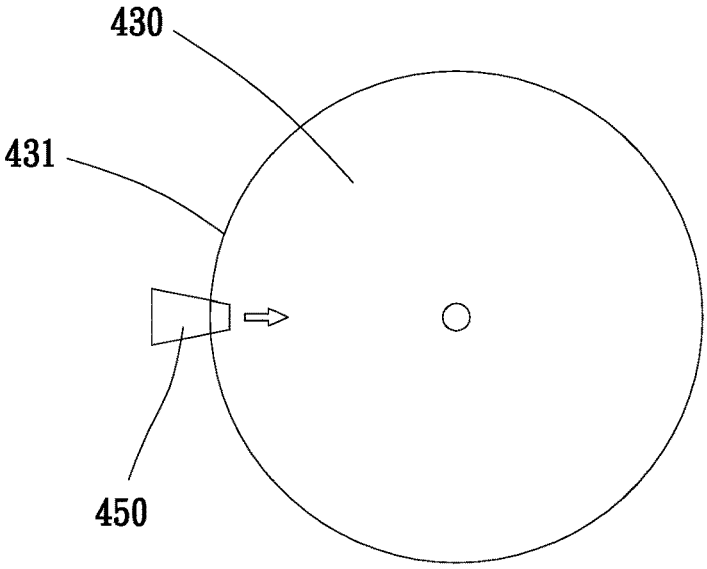
FIG. 16 shows a relative relationship between the magnet and the metal disc in the present invention.

FIG. 16 illustrates a relative relationship between the magnet and the metal disc in the present invention, wherein the outer edge of the metal disc 430 farthest away from its rotation axis forms a circular edge 431, and the magnet 450 is located near the circular edge 431 of the metal disc 430. Specifically, the shape of the cross section of the magnet 450 gradually widens from the side closer to the rotation axis of the metal disc 430 to the other side farther away from the rotation axis of the metal disc 430, so that when the magnet 450 crosses the circular edge 431 and approaches the rotation axis of the metal disc 430 (e.g. the direction indicated by the arrow in the figure), the projection area of the magnet 450 on the metal disc 430 is increased, and the resistance applied to the metal disc 430 is increased correspondingly. That is, the magnet 450 can be operated to move between two opposite ends of an adjustment path (not shown), and a first end corresponding to the minimum resistance is farther away from the rotation axis of the metal disc 430 than a second end corresponding to the maximum resistance. The structures shown in FIG. 6, FIG. 14 and FIG. 15 all belong to this type.

Figure 17:
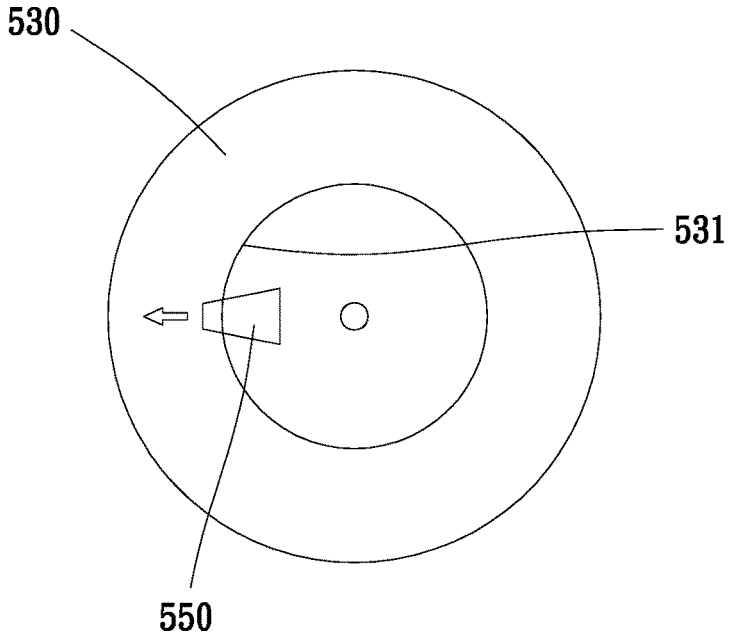
FIG. 17 shows another relative relationship between the magnet and the metal disc in the present invention.

FIG. 17 illustrates another relationship between the magnet and the metal disc, wherein the metal disc 530 is ring-shaped, which may be coaxially fixed to a flywheel so as to rotate in place with the flywheel about a rotation axis. The inner edge of the metal disc 530 close to the rotation axis forms a circular edge 531. The magnet 550 is located at the inner edge of the metal disc 530, namely, near the circular edge 531. The shape of the cross section of the magnet 550 gradually widens from the side farther away from the rotation axis of the metal disc 530 to the side closer to the rotation axis of the metal disc 530, so that when the magnet 550 crosses the circular edge 531 and moves away from the rotation axis of the metal disc 530 (e.g. the direction indicated by the arrow in the figure), the projection area of the magnet 550 on the metal disc 530 is increased, and the resistance applied to the metal disc 530 is increased correspondingly. That is, the magnet 550 can be operated to move between two opposite ends of an adjustment path (not shown), and a first end corresponding to the minimum resistance is closer to the rotation axis of the metal disc 530 than a second end corresponding to the maximum resistance.

There may be only one magnet in the present invention, which is separately located on one side of the metal disc, with its specific shape facing toward the metal disc, which can also cause the rotating metal disc to generate eddy current effects and form rotational resistance so as to achieve the aforementioned effect of the present invention when adjusting the resistance.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A resistance adjustment device of an exercise apparatus, comprising:

a frame;

a metal disc pivotally mounted on the frame about a rotation axis, and movement of a user of the exercise apparatus causing rotation of the metal disc, the metal disc defining an outer edge;

a bracket movably mounted on the frame; and at least one magnet disposed on the bracket, the at least one magnet having a non-circular cross section defining a first edge and a second edge, both the first edge and the second edge having a front end and a rear end, the two front ends being located at the same side and separated by a first distance, the two rear ends being located at the other side and separated by a second distance greater than the first distance, the cross section of the at least one magnet having a width between the first edge and the second edge, the width of the at least one magnet being gradually enlarged from a front side where the two front ends are located to a rear side where the two rear ends are located, wherein the at least one magnet being movable along an adjustment path across the outer edge of the metal disc to approach or move away, from the rotation axis along with movement of the bracket so as to increase or decrease an overlapping area of the at least one magnet and the metal disc;

wherein when the at least one magnet is located at a first end of the adjustment path, the overlapping area is at a minimum value within an adjustable range, and when the at least one magnet is located at a second end of the adjustment path, the overlapping area is at a maximum value within the adjustable range.

2. The resistance adjustment device as claimed in claim 1, wherein the bracket is pivotally mounted on the frame about a swing axis parallel to the rotation axis, and wherein the orientation between the first edge and the second edge of the cross section of the at least one magnet corresponds to the orientation between the at least one magnet and the swing axis.

3. The resistance adjustment device as claimed in claim 2, wherein the first edge of the cross section of the at least one magnet is closer to the swing axis than the second edge, and the length of the second edge is greater than the length of the first edge.

4. The resistance adjustment device as claimed in claim 3, wherein the cross section of the at least one magnet further has a short edge and a long edge opposite to each other, the short edge connecting the front ends of the first edge and the second edge, the long edge connecting the rear ends of the first edge and the second edge; wherein when the at least one magnet is located at the first end of the adjustment path, the short edge of the cross section approaches or overlaps the outer edge of the metal disc; and wherein when the at least one magnet is located at the second end of the adjustment path, the long edge of the cross section approaches or overlaps the outer edge of the metal disc.

5. The resistance adjustment device as claimed in claim 1, wherein when the at least one magnet is located at the first end of the adjustment path, at least one of the first edge and the second edge of the cross section of the at least one magnet intersects the outer edge of the metal disc.

6. The resistance adjustment device as claimed in claim 5, wherein during a period of the at least one magnet moving along the adjustment path from the first end to the second end, the overlapping area increases at least 5% to 95% of a difference between the maximum value and the minimum value, and both the first edge and the second edge of the at least one magnet are kept passing through the outer edge of the metal disc at the same time.

7. The resistance adjustment device as claimed in claim 1, wherein the first edge and the second edge are two non-parallel straight lines.

8. The resistance adjustment device as claimed in claim 1, wherein the cross section of the at least one magnet further has a short edge which connects the front ends of the first edge and the second edge, and wherein when the at least one magnet is located at the first end of the adjustment path, the short edge of the cross section approaches or overlaps the outer edge of the metal disc.

9. The resistance adjustment device as claimed in claim 1, wherein the cross section of the at least one magnet further has a long edge which connects the rear ends of the first edge and the second edge, and wherein when the at least one magnet is located at the second end of the adjustment path, the long edge of the cross section approaches or overlaps the outer edge of the metal disc.

10. The resistance adjustment device as claimed in claim 1, wherein the at least one magnet includes two opposite magnets located at two opposite sides of the metal disc; each magnet of the two opposite magnets has an inner side with a shape corresponding to the cross section; the inner side of each of the magnets is parallel to the corresponding side of the metal disc and spaced apart by a distance; and axial projections of the two opposite magnets on the metal disc are overlapped with each other.

11. A resistance adjustment device of an exercise apparatus, comprising:

a frame;

a metal disc pivotally mounted on the frame about a rotation axis, and movement of a user of the exercise apparatus causing rotation of the metal disc, the metal disc defining an outer edge;

a bracket movably mounted on the frame; and at least one magnet disposed on the bracket, the at least one magnet having a non-circular cross section, the at least one magnet being movable along an adjustment path across the outer edge of the metal disc to approach or move away from the rotation axis along with movement of the bracket so as to increase or decrease a projection area of the at least one magnet on the metal disc for increasing or decreasing resistance applied to the metal disc, the cross section of the at least one magnet gradually widening from a front side closer to the rotation axis of the metal disc to a rear side farther away from the rotation axis of the metal disc;

wherein when the at least one magnet is operable to move from a first end to a second end of the adjustment path, the projection area is increased from a minimum value to a maximum value, and the resistance applied to the metal disc is increased from a minimum resistance to a maximum resistance.

12. The resistance adjustment device as claimed in claim 11, wherein the cross section of the at least one magnet is a quadrilateral which defines a first edge at a top side, a second edge at a bottom side, a short edge at the front side, and a long edge at the rear side, and wherein the first edge and the second edge are opposite but not parallel to each other.

13. The resistance adjustment device as claimed in claim 12, wherein when the at least one magnet is located at the first end of the adjustment path, at least one of the first edge and the second edge of the cross section of the at least one magnet intersects the outer edge of the metal disc.

14. The resistance adjustment device as claimed in claim 13, wherein when the at least one magnet moves along the adjustment path from the first end to the second end, the projection area increases at least 5% to 95% of a difference between the maximum value and the minimum value, and both the first edge and the second edge of the at least one magnet are kept passing through the outer edge of the metal disc at the same time.

15. The resistance adjustment device as claimed in claim 12, wherein when the at least one magnet is located at the first end of the adjustment path, the short edge of the cross section approaches or overlaps the outer edge of the metal disc; and wherein when the at least one magnet is located at the second end of the adjustment path, the long edge of the cross section approaches or overlaps the outer edge of the metal disc.

16. The resistance adjustment device as claimed in claim 11, wherein when the at least one magnet is operated to move from the first end to the second end of the adjustment path to approach the rotation axis at a constant speed, an increase rate of the projection area is gradually accelerated and an increase rate of the resistance applied to the metal disc is gradually accelerated correspondingly.

17. The resistance adjustment device as claimed in claim 11, wherein the at least one magnet includes two opposite magnets located at two opposite sides of the metal disc; each magnet of the two opposite magnets has an inner side with a shape corresponding to the cross section; the inner side of each of the magnets is parallel to the corresponding side of the metal disc and spaced apart by a distance; and axial projections of the two opposite magnets on the metal disc are overlapped with each other.

* * * * *